US008602689B1

(12) United States Patent
Van Polen et al.

(10) Patent No.: US 8,602,689 B1
(45) Date of Patent: Dec. 10, 2013

(54) RETRACTABLE NOSE CONE SYSTEM AND METHOD FOR FORMING REINFORCED CONCRETE PILINGS AND/OR AN ELECTRICAL GROUNDING SYSTEM

(75) Inventors: Kenneth Van Polen, Dahlonega, GA (US); George E. Butler, II, Dahlonega, GA (US)

(73) Assignee: Heli-Crete "Eco-Friendly" Piling Systems, LLC, Dahlonega, GA (US)

( * ) Notice: Subject to any disclaimer, the term of this patent is extended or adjusted under 35 U.S.C. 154(b) by 127 days.

(21) Appl. No.: 13/152,697

(22) Filed: Jun. 3, 2011

(51) Int. Cl.
*E02D 7/28* (2006.01)
*E21B 7/26* (2006.01)

(52) U.S. Cl.
USPC ..... 405/249; 175/23

(58) Field of Classification Search
USPC ..... 405/249, 253, 242, 252.1; 175/22, 23; 52/157, 158; 403/109.6, 109.7
See application file for complete search history.

(56) References Cited

U.S. PATENT DOCUMENTS

| | | | | | |
|---|---|---|---|---|---|
| 51,801 | A | * | 1/1866 | Castle | 175/23 |
| 234,151 | A | * | 11/1880 | Vaughn | 175/23 |
| 872,093 | A | * | 11/1907 | Stewart | 175/236 |
| 1,969,251 | A | * | 8/1934 | Bald | 175/23 |
| 3,628,337 | A | * | 12/1971 | Stepanich et al. | 405/253 |
| 3,894,589 | A | * | 7/1975 | Ciraud | 175/23 |
| 4,708,530 | A | | 11/1987 | Faber | |
| 5,088,681 | A | * | 2/1992 | Procaccianti et al. | 248/530 |
| 5,257,559 | A | * | 11/1993 | Cannetti | 81/445 |
| 5,683,207 | A | * | 11/1997 | Mauer | 405/244 |
| 5,833,399 | A | | 11/1998 | Bullivant | |
| 5,927,905 | A | | 7/1999 | Van Halteren | |
| 6,341,614 | B1 | * | 1/2002 | Tucker et al. | 135/75 |
| 6,652,195 | B2 | | 11/2003 | Vickers et al. | |
| 6,814,525 | B1 | | 11/2004 | Whitsett | |
| 6,824,331 | B2 | | 11/2004 | Parker | |
| 7,004,683 | B1 | | 2/2006 | Rupiper | |
| 7,731,454 | B1 | | 6/2010 | Watson et al. | |
| 2006/0127188 | A1 | | 6/2006 | Francis | |
| 2010/0319272 | A1 | * | 12/2010 | Kellner | 52/157 |

FOREIGN PATENT DOCUMENTS

| | | | | |
|---|---|---|---|---|
| EP | 185402 | A1 | * | 6/1986 |
| JP | 04343913 | A | * | 11/1992 |

* cited by examiner

*Primary Examiner* — Tara M. Pinnock
*Assistant Examiner* — Kyle Armstrong
(74) *Attorney, Agent, or Firm* — Smith Risley; Steven P. Wigmore

(57) ABSTRACT

A reusable nose cone device (and related retrieval apparatus) in a hollow helical piling system having a terminal helical anchor are described. The method and system include placing or installing either (i) reinforced concrete piles in situ and/or (ii) grounding systems into the ground—without utilizing a pile driver or an auger, without deconsolidating the surrounding earth and creating spoils (as with an auger), and without unnecessary sacrifice of materials. A terminal helical anchor may be installed through the hollow center of the helical piling system into the ground. The helical anchor may be installed after the removal of the nose cone device. With the system and method, independent and accurate measurement of the anchor's torque may be made and hence complementary "load" bearing, or compression, (or "pull" resisting, or tensioning) capacity may be determined prior to filling the entire pile with reinforced wet concrete.

19 Claims, 14 Drawing Sheets

RETRACTABLE NOSE CONE SYSTEM AND METHOD FOR FORMING REINFORCED CONCRETE PILINGS AND/OR AN ELECTRICAL GROUNDING SYSTEM

BACKGROUND

1. Field of Invention

The present invention relates generally to a retractable nose cone apparatus for use with a hollow helical piling system and terminal helical anchor and methods for placing or installing either (i) reinforced concrete piles in situ without utilizing a pile driver or an auger, without unnecessary sacrifice of materials, and with the opportunity for efficient use of a terminal helical anchor and/or (ii) an electrical grounding system using a copper-bonded helical anchor and grounding grout.

2. Conventional Art

Pilings are often used to support buildings, bridges, antenna structures, and other structures—some of which also require electrical grounding. Pilings are known as either compression or tension pilings depending on whether the pile is designed to withstand forces that tend to push it into the ground (i.e., a compression pile) or pull it out of the ground (i.e., a tension pile). Conventionally, reinforced concrete piles have been placed or poured in the ground by one of two methods. The first method pours a precast reinforced concrete pile into the ground by using a pile driver and hammering the pile into the ground. The second method places a reinforced concrete pile in situ by drilling a circular hole into the ground using an auger, removing the soil, placing a pre-assembled steel reinforcing rod cage into the hole and pouring wet concrete into the hole to encase the steel reinforcing rod cage.

By contrast, conventional helical piling systems typically include one or more hollow metal helical pipes or screws or helices. The metal shaft or casing is rotated via a surface torque motor to force the helical screw downward into the earth until the screw is seated in a region of soil sufficiently strong to support the load or withstand the pull from the structure that it is to support. Additional pilings or metal casings can be attached or spliced to a previously screwed piling or metal casing to increase the depth of the overall piling. To accomplish this, adjacent round or circular ends of the pilings are usually reconfigured to have a generally square shape with rounded corners. The adjacent ends are configured to have male and female cross-sections so that the piles slide together forming a telescoping joint and are spliced to make a continuous piling.

U.S. Pat. No. 6,814,525 issued to Whitsett discloses a conventional helical piling apparatus and installation methods. The Whitsett patent discloses in its Abstract, for example, that an "in-situ pile apparatus includes a helical anchor to which a plurality of elongated generally cylindrically shaped sections can be added. Each of the sections has a specially shaped end portion for connecting to another section. An internal drive is positioned in sections inside the bore of each of the connectable pile sections. The internal drive includes enlarged sections that fit at the joint between pile sections. In one embodiment, the internal drive can be removed to leave a rod behind that defines reinforcement for an added material such as concrete. The rod also allows for a tension rod connection from the anchor tip to an upper portion attachment point."

Another conventional helical pipe piling apparatus is distributed by MacLean Dixie HFS. It is like a large hollow cylindrical metal screw with a conical nose assembly ("nose cone"). Once seated in the ground, this hollow piling apparatus could be filled with reinforcing rods and wet concrete; however, the valuable steel pipe casings and nose cone would remain in the ground. A conventional helical pipe piling apparatus is disclosed in U.S. Pat. No. 5,833,399 and involves a single or "one [long] extension member" and the use of an expensive, tall, and difficult to transport drilling rig and pump truck. Because of the fact that the wet cementitious material must be applied through the single extension member to the unlined hole under pressure, this complicates the difficulty and expense of connecting multiple sections.

In view of the problems with conventional pilings, a piling method and system which is portable, which does not sacrifice expensive construction materials by leaving them in the ground, and which also permits the installer to independently measure and increase the torque of a terminal helical anchor, are needed in the art.

SUMMARY

A method and system for installing a piling include sliding a detachable nose cone device through a coupler section of a pipe. Next, the detachable nose cone device may be coupled to the coupler section of the pipe by activating one or more locking mechanisms. Activating the one or more locking mechanisms may include extending shear pins by rotating a shaft that causes shear pins to extend.

A method and system for installing a piling may include a detachable nose cone device and a coupler section of a pipe. The detachable nose cone device may slidably engage with the coupler section of the pipe. The detachable nose cone device may be coupled to the coupler section of the pipe by one or more locking mechanisms. The system may further include a picking device that is slidably engagable with the detachable nose cone device. The picking device may remove the detachable nose cone device from the coupler section of the pipe by pulling the detachable nose cone device through the coupler section.

BRIEF DESCRIPTION OF THE DRAWINGS

The various features, functionalities and practical advantages of the present invention may be more readily understood with reference to the following detailed description taken in conjunction with the accompanying drawings, wherein like reference numerals designate like structural elements, and in which.

DETAILED DESCRIPTION

Disclosed are a retractable nose cone apparatus and a retrieval (or "picker") apparatus for use with a hollow helical piling system and terminal helical anchor. Also disclosed are methods for placing or installing either (i) reinforced concrete piles and/or (ii) grounding systems into the ground—without utilizing a pile driver or an auger and without unnecessary sacrifice of materials.

In accordance with the teachings disclosed herein, a torque generating motor on the surface is used to screw into the ground helical pipe sections or casings with a single nose cone device at their distal end to facilitate penetration into the ground. Eventual removal of the nose cone device through the hollow interior of the pipe sections is accomplished using the retrieval (or "picker") apparatus. Once the nose cone device is removed with the retrieval apparatus, the installer has multiple options.

On the one hand, a preassembled steel reinforcing rod cage may be placed into the pipe sections in the ground; wet concrete may be poured into the pipe sections to encase the steel reinforcing rod cage; and the helical pipe sections may then be removed. On the other hand, with the compacted earth beneath the hollow pipe sections exposed by the removal of the nose cone device, the installer may choose to insert a helical anchor into the ground from the surface through the hollow center of the pipe sections.

The torque for the helical anchor may be applied and measured separately from that of the larger diameter helical pilings or casings. In such a situation, the continuous and interconnected square or round shaft of the helical anchor that extends all the way to the surface can serve as a reinforcement system in lieu of a steel reinforcing rod cage. The helical anchor with its shaft may also supply potentially valuable electrical grounding capabilities, especially if a copper-bonded helical anchor and grounding grout are employed. Wet concrete may be poured into the pipe sections to encase the round or square shaft of the helical anchor. Meanwhile, the helical pipe sections may then be removed.

Brief Overview of System/Apparatus 10

Figure 1:
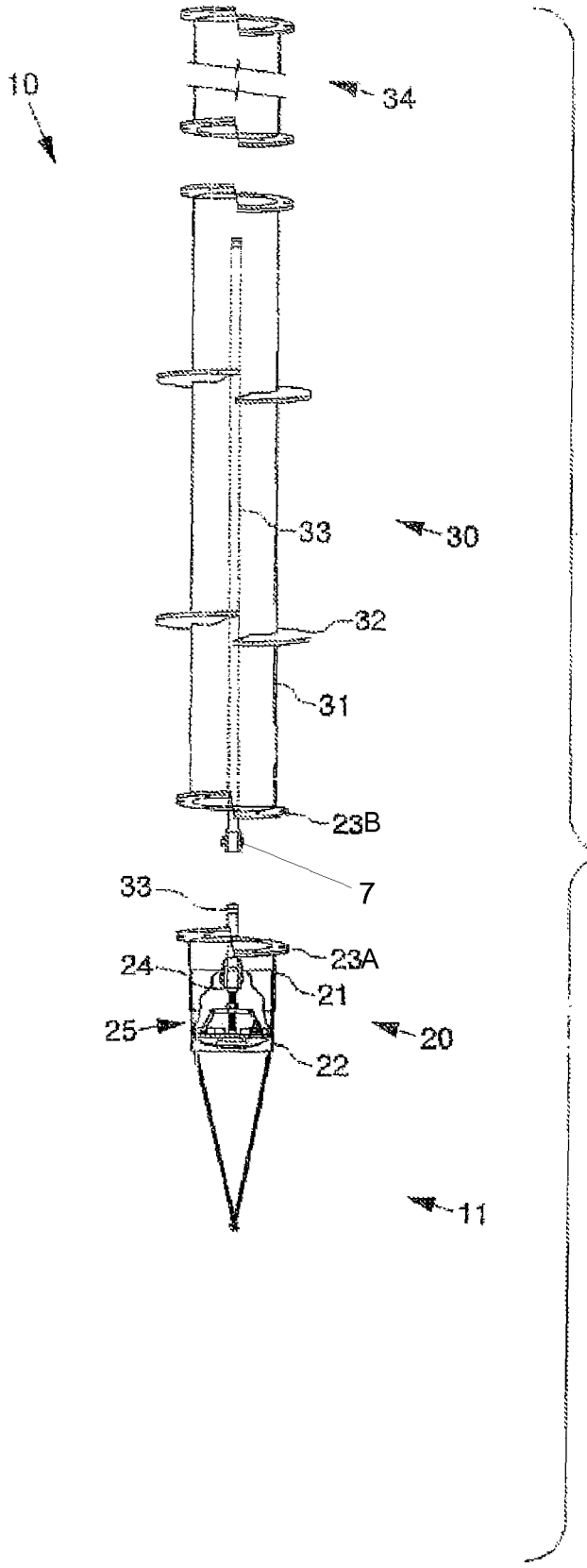
FIG. 1 is an elevational view of exemplary piling apparatus prior to removal of integral coupler assembly/nose cone device.
Figure 2:
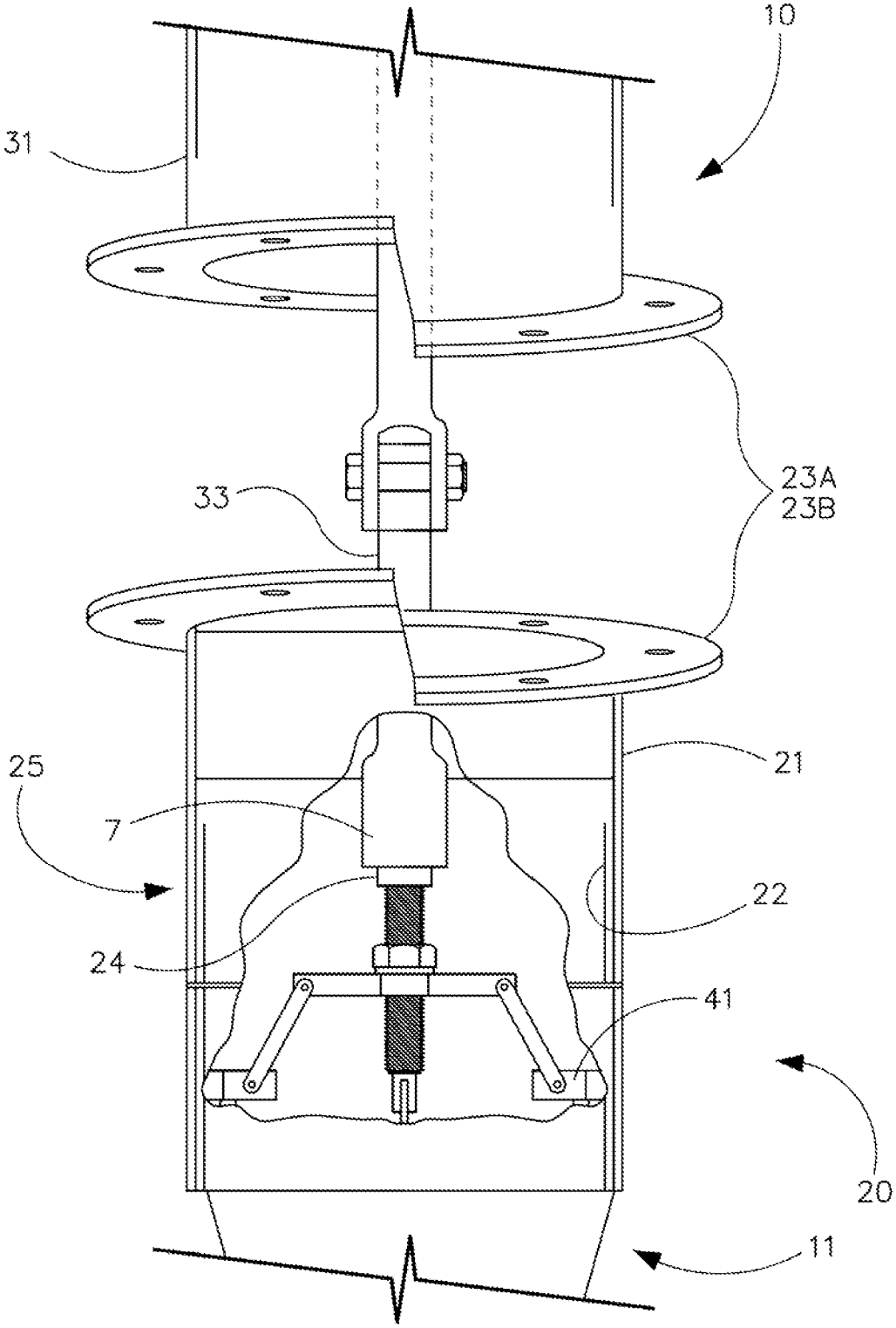
FIG. 2 is an enlarged cut-away view of the integral coupler assembly/nose cone device 11 (used in the apparatus shown in FIG. 1) shown inside coupler section with shear pins disengaged.

Referring to the drawing Figures, FIGS. 1-6 illustrate various views of exemplary piling apparatus 10. More particularly, FIG. 1 is an elevational view of exemplary piling apparatus 10. FIG. 2 is an enlarged cut-away view of the integral coupler assembly/nose cone device 11 (used in the apparatus shown in FIG. 1) shown inside coupler section 20 with shear pins 44 disengaged.

Figure 3:
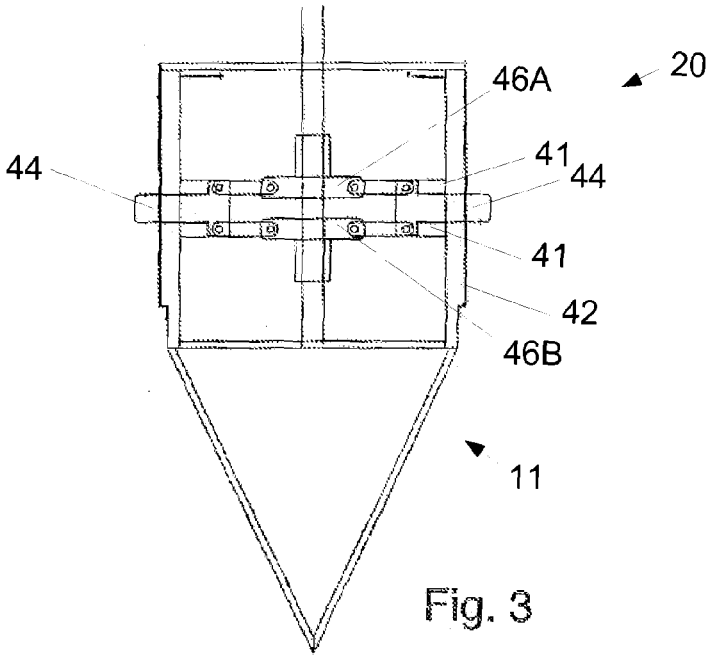
FIG. 3 is a sectional view of the integral coupler assembly/nose cone device (depicted in FIG. 2) without the splice ring and with the shear pins extended.
Figure 4:
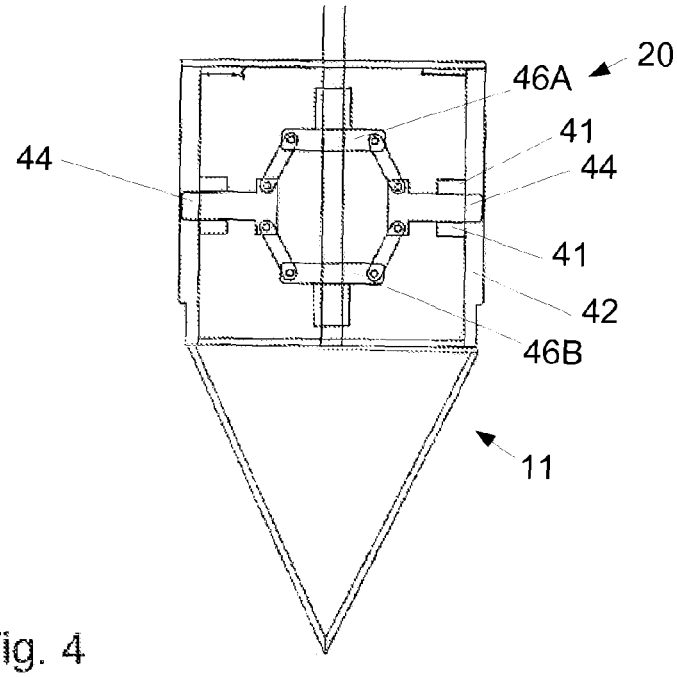
FIG. 4 is a sectional view of the integral coupler assembly/nose cone device (depicted in FIG. 2) without the splice ring and with the shear pins retracted.
Figure 5:
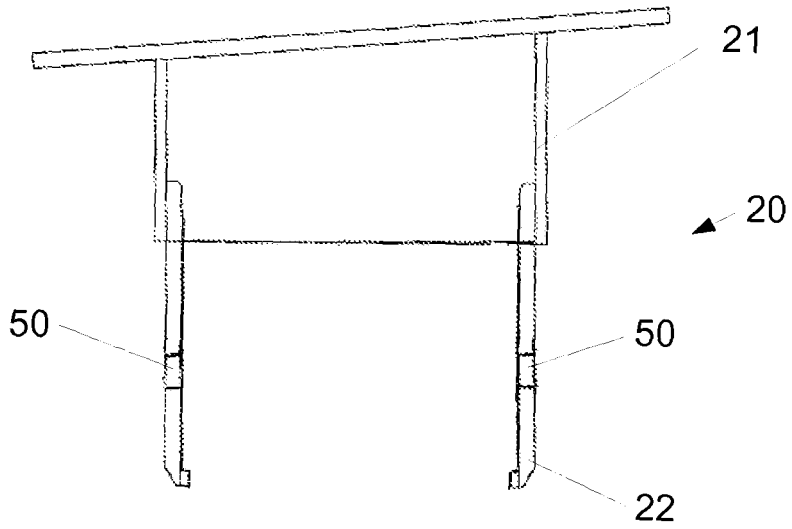
FIG. 5 is a sectional view of coupler pipe section with the splice ring (used in the apparatus shown in FIG. 1) and with the integral coupler assembly/nose cone device removed.

FIG. 3 is a sectional view of the integral coupler assembly/nose cone device 11 (depicted in FIG. 2) shown outside coupler section 20 with shear pins 44 extended. FIG. 4 is a sectional view of the integral coupler assembly/nose cone device 11 (depicted in FIG. 2) shown outside coupler section 20 with shear pins 44 retracted. FIG. 5 is a sectional view of coupler section 20 (used in the apparatus shown in FIG. 1) with the integral coupler assembly/nose cone device 11 removed.

Figure 6:
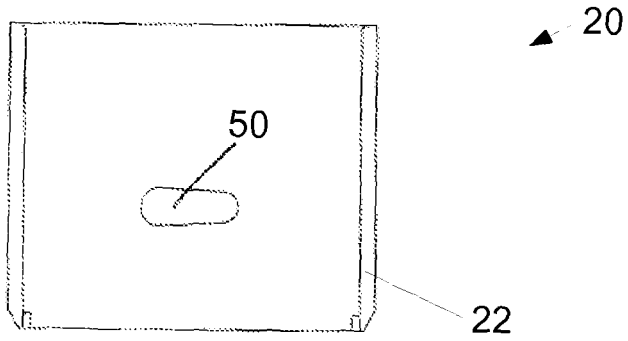
FIG. 6 is a plan view of the internal wall of the inner splice ring of coupler section showing one of six slotted or elongated holes designed to receive the shear pins within the integral coupler assembly/nose cone device.

FIG. 6 is a plan of the internal wall of the inner splice ring 22 of the coupler section 20 showing one of the six slotted or elongated holes 50 designed to receive the shear pins 44 within the integral coupler assembly/nose cone device 11. The slotted holes 50 may be designed to facilitate the ultimate removal and retrieval of the integral coupler assembly/nose cone device 11 from coupler section 20. The holes 50 may facilitate removal of the nose cone device 11 by simple counterclockwise rotation of the entire piling apparatus 10 by use of a surface torque motor. This may relieve any stress on the shear pins 44 extended from the integral coupler assembly/nose cone device 11 into the slotted holes 50 and allow their disengagement.

Figure 7A:
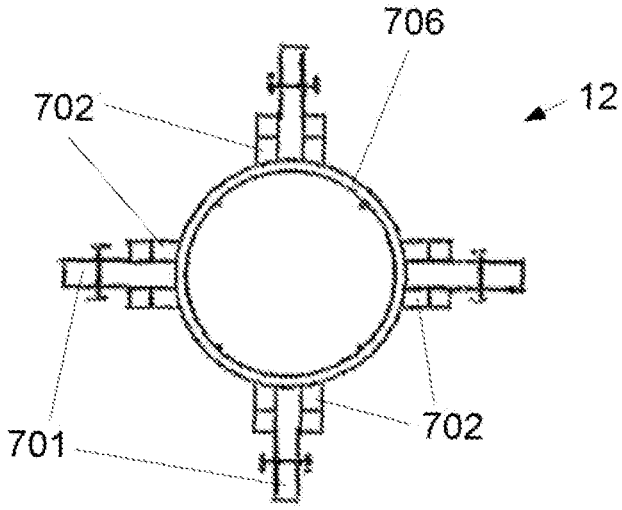
FIG. 7A is a top plan view of a "picker" apparatus.
Figure 7B:
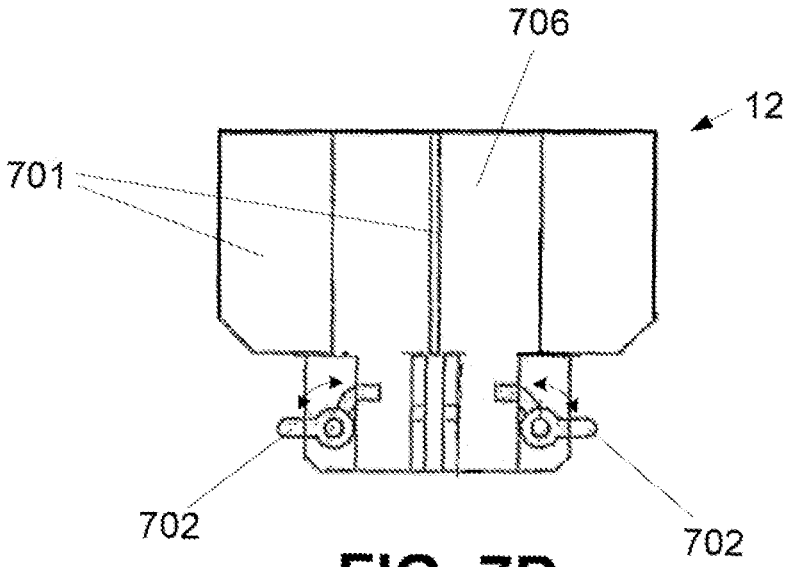
FIG. 7B is a side plan view of a the picker apparatus of FIG. 7A designed to be lowered from the surface through the hollow interior of the superjacent helical pipe assembly into the open top of the integral coupler assembly/nose cone device.
Figure 8:
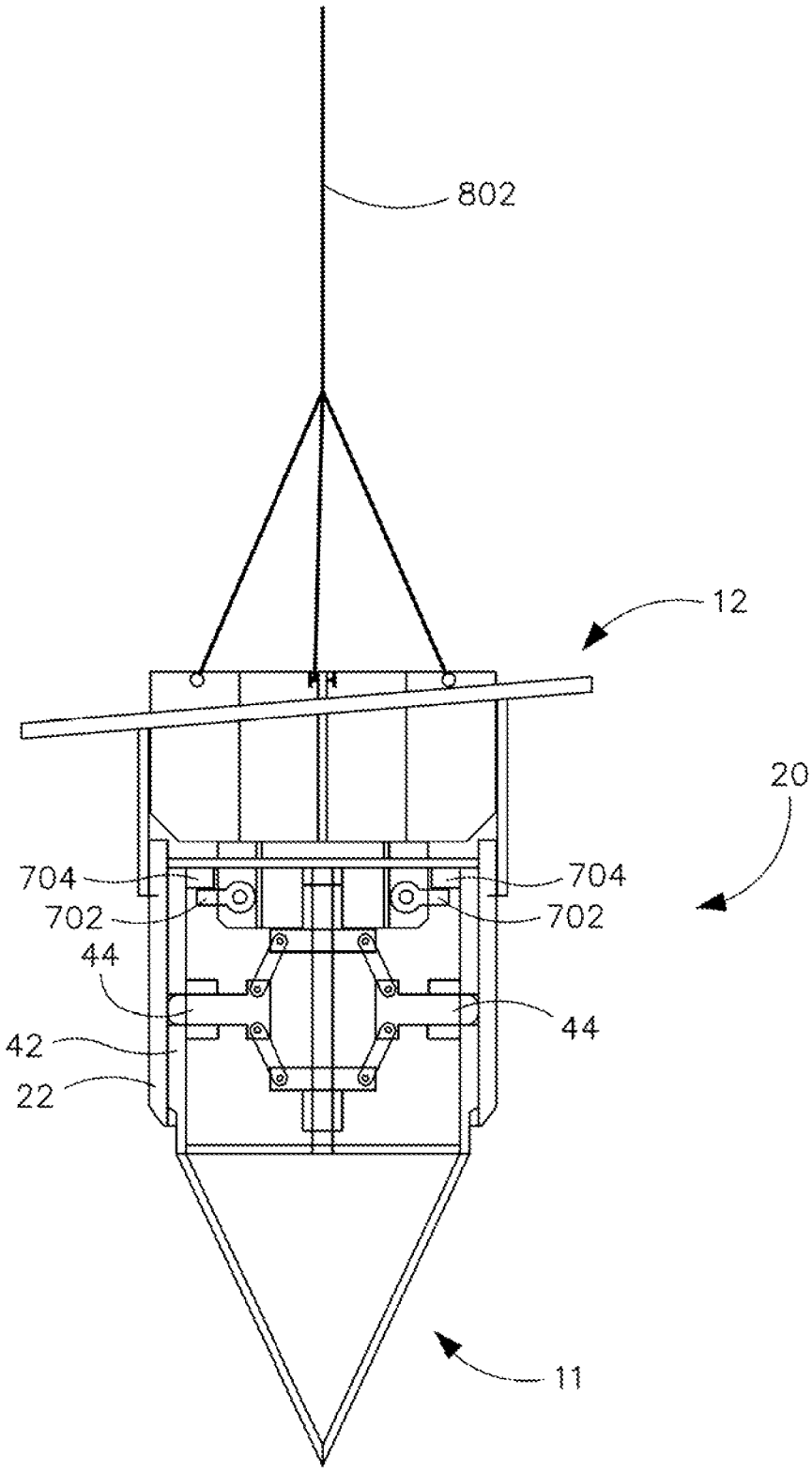
FIG. 8 is a plan view showing the "picker" apparatus after being lowered from the surface and deployed inside the top of the integral coupler assembly/nose cone device while still inside the coupler section.

FIG. 7A is a plan view of the top and side of the "picker" apparatus 12 designed to be lowered from the surface through the hollow interior of the piling apparatus 10 into the open top of the integral coupler assembly/nose cone device 11. Referring briefly to FIGS. 7A-B, once the shear pins 44 have been disengaged from the coupler pipe section and the vertical disengagement shaft removed, eight upwardly hinged pins 702 will fall back into place beneath projecting top flanges 704 of the integral coupler assembly/nose cone device 11. This allows for the swift removal of the nose cone device through the coupler section 20 to the surface by means of a cable 802—which is shown positioned above coupler section 20 in FIG. 8. FIG. 8 further illustrates the "picker" apparatus 12 after being lowered from the surface and deployed inside the top of the integral coupler assembly/nose cone device 11 while still inside coupler section 20.

Figure 11:
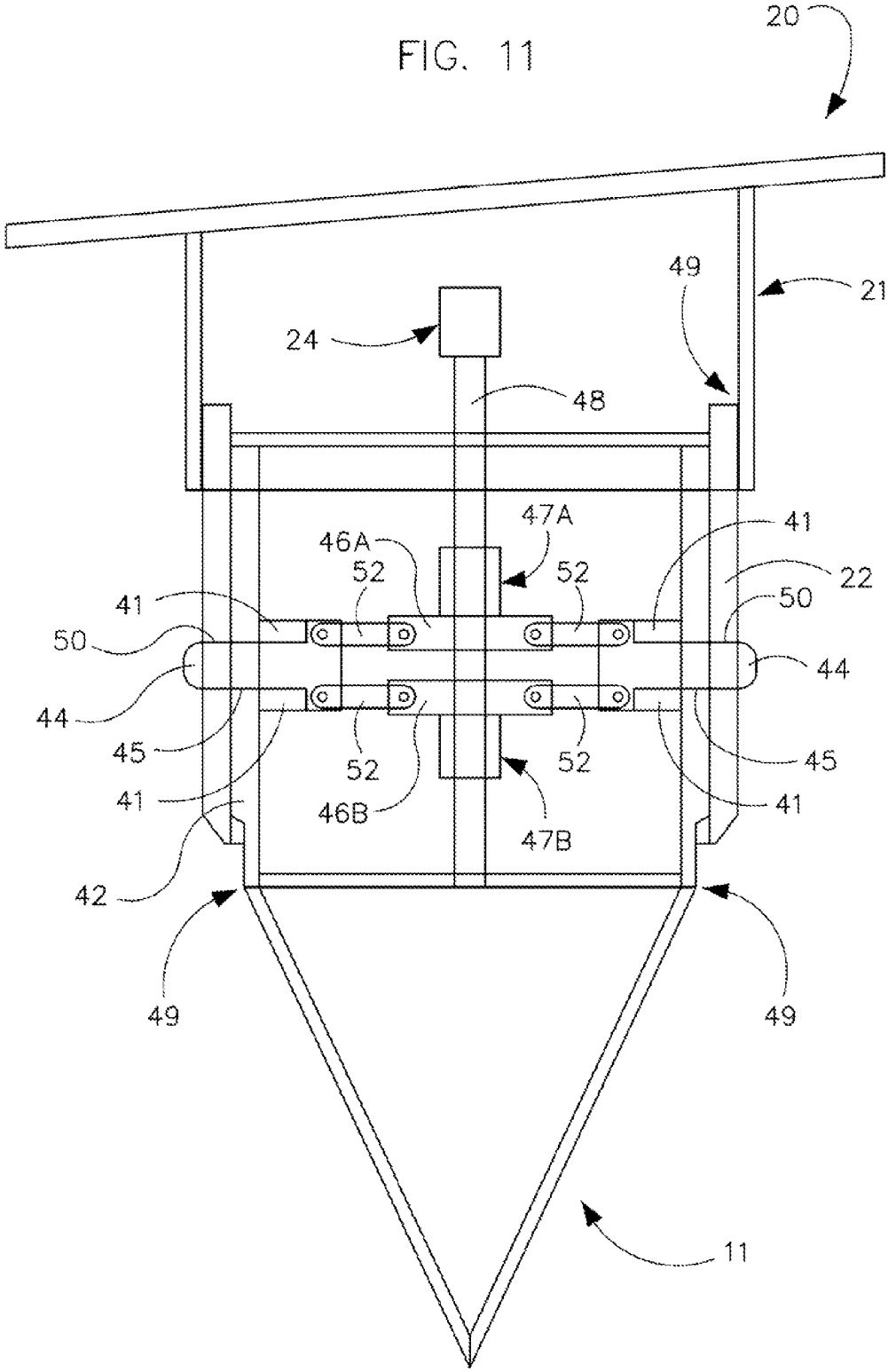
FIG. 11 is an enlarged sectional view of the integral coupler assembly/nose cone device (used in the apparatus shown in FIG. 1) shown inside coupler section with shear pins engaged.

Referring briefly to FIG. 11, this Fig. is an enlarged sectional view of the integral coupler assembly/nose cone device 11 (used in the apparatus shown in FIG. 1) shown inside coupler section 20 with shear pins 44 engaged. Further details about the nose cone device 11 as illustrated in FIG. 11 will be described in detail below.

Main Elements of System/Apparatus 10

Referring now back to FIGS. 1-2, the exemplary piling apparatus 10 comprises an integral coupler assembly/nose cone device 11. The piling apparatus 10 also comprises a coupler section 20, shown in detail in FIGS. 2, 5, 6, 7, 8, & 11. The coupler section 20 includes a coupler pipe section 21 with an inner splice ring 22 attached to the coupler pipe section 21, and a helical flange 23A attached at its upper end of the coupler pipe section 21. A removable and integral coupler assembly/nose cone device 11 is disposed within and below the coupler section 20.

A short square male shaft bar 24 extends from the upper end of the coupler assembly/nose cone device 11 to just below helical flange 23A of the coupler pipe section 21. A removable segmented metal shaft 33 with a terminal magnetized female fitting 7 sits down over short square male shaft bar 24. The removable segmented metal shaft 33 extends from male shaft 24 of the nose cone device 11 to the surface. The removable segmented shaft 33 is generally used after pipe sections 30 have been installed in (rotated into) the ground. The segmented shaft 33 is used to remove the nose cone device 11 as will be described below.

The coupler pipe section 21 is coupled to a pipe section 30 with the standard width helical flanges 23A, 23B. That is, the coupler pipe section 21 as illustrated in FIG. 2 has a standard width helical flange 23A which mates with a standard width helical flange 23B that is part of the pipe section 30, and particularly a lower portion 31 of the pipe section 30. The helical flanges 23A, 23B may be coupled together using fastening devices such as bolts in possible combination with alignment pins. However, other reversible fastening or clamping devices, such as screws and other similar devices are included within the scope of the system 10.

As noted previously, the short square shaft bar 24 of the nose cone device 11 is coupled to a section of square shaft bar 33 that extends through the pipe section 30. Additional pipe sections 30 are coupled together as required to achieve the desired depth in the ground. A final pipe section 34 as illustrated in FIG. 1 may be provided without intermediate helices 32 and it may be disposed above the surface at the upper end of the apparatus/system 10.

Referring briefly now to FIG. 11, the coupler pipe section 21 has welds 49 to attach it to the splice ring 22. However, other fastening devices may be used. Other fastening devices include, but are not limited to, bolts, screws, rivets, and other similar devices. The coupler assembly portion of the integral coupler assembly/nose cone device 11 comprises a plurality of thrust guide plates 41 that are attached to an exterior wall 42 of the coupler assembly.

A plurality of transversely slidable shear pins 44 are designed to slide inside the thrust guide plates 41. The thrust guide plates 41 channel the shear pins into the shear pin holes 45 in the exterior wall 42 of the coupler assembly.

The shear pins 44 are attached to the shear pin positioning arms 52. The shear pins 44 with the assistance of the thrust guide plates 41 are aligned with a corresponding plurality of shear pin holes 45 in the exterior wall 42. In addition, the shear pin holes 45 in the exterior wall 42 are aligned with the elongated shear pin holes 50 in splice ring 22.

Referring briefly to FIGS. 3-4, FIG. 3 is a sectional view of the integral coupler assembly/nose cone device 11 (depicted in FIG. 2) without the splice ring 22 shown and with the shear pins 44 extended. While shear pins 44 as illustrated in FIGS. 3-4 facilitate the locking and unlocking of the nose cone device 11, one of ordinary skill in the art recognizes that other mechanical equivalents to shear pins 44 may be utilized without departing from the scope and spirit of the system 10. For example, instead of shear pins 44, spring biased bearings or roller balls (not illustrated) may be used to facilitate the locking and unlocking of the nose cone device 11 with respect to the splice ring 22.

In FIG. 3, the threaded rod 48 has been rotated clockwise such that the first upper plate 46A and the second lower plate 46B move towards one another. This relative motion causes the shear pins 44 to extend through the shear pin holes 45 in the wall 42 of the coupler assembly and between the thrust guide plates 41.

FIG. 4 is a sectional view of the integral coupler assembly/nose cone device 11 (depicted in FIG. 2) without the splice ring 22 shown and with the shear pins 44 retracted. In FIG. 4, the threaded rod 48 has been rotated counter-clockwise such that the first upper plate 46A and the second lower plate 46B move away from one another. This relative motion causes the shear pins 44 to retract from the shear pin holes 45 in the wall 42 and from between the thrust guide plates 41.

FIG. 5 is a sectional view of coupler pipe section 21 with the splice ring 22 (used in the apparatus shown in FIG. 1) and with the integral coupler assembly/nose cone device 11 removed. The splice ring 22 includes a plurality of elongated holes 50 as will be described in further detail below in connection with FIG. 6.

FIG. 6 is a plan view of the internal wall of the inner splice ring 20 of the coupler section of nose cone device 11. This view illustrates one of six slotted or elongated holes 50 designed to receive the shear pins 44 (not shown in this Fig.) within the integral coupler assembly/nose cone device 11. The nose cone device 11 is also not illustrated in FIG. 6 so that the elongated shape of the holes is easily viewed. This elongated shape is designed to facilitate relief of binding pressure on shear pins 44 by simple counterclockwise rotation of the entire pipe assembly; and it may comprise a length dimension and width dimension, in which the length dimension is substantially greater than the width dimension. However, other shapes for the holes 50 are included within the scope of the system 10. Other shapes include, but are not limited to, circular, square, round, curved, etc.

As understood by one of ordinary skill in the art, any number of shear pins 44 and corresponding shear pin holes 45 of the coupler assembly and holes 50 of the splice ring may be employed. The actual number of shear pins 44 and shear pin holes 45 and 50 may vary depending on a particular overall design.

Referring now back to FIG. 11, the short square male shaft bar 24 of the nose cone device 11 is attached to a threaded rod 48 that extends through nuts 47A and 47B. Nuts 47A-47B are welded to upper and lower coupler plates 46A,B. First nut 47A may be reverse threaded while the second nut 47B may have standard threads. The shear pins 44 are attached to the upper and lower coupler plates 46A,B by way of a plurality of shear pin position arms 52.

The integral coupler assembly/nose cone device 11 is lowered down into coupler section 20 and oriented such that the shear pins 44 are aligned with the shear pin holes 50 in the inner splice ring 22. Horizontal movement of the shear pins 44 is controlled by rotating the threaded rod 48 via the square male shaft bar 24. Clockwise movement of the threaded rod 48 will cause the upper coupler plate 46A to lower and the lower coupler plate 46B to rise and force the shear pins 44 outward, and vice versa. This relative movement of the plates 46A, B and shear pins 44 is illustrated in FIGS. 3 and 4.

FIG. 7A is a top plan view of a "picker" apparatus 12. The picker apparatus 12 may comprise a cylindrical section 706 that supports a plurality of fins or planar projections 701. On each side of a particular fin 701, an upwardly hinged pin 702 may be provided. While a cylindrical section 706N and corresponding fins 701 are illustrated in FIG. 7A, one of ordinary skill the art recognizes that other mechanical structures may be employed for the picker apparatus 12 without departing from the scope and spirit of the system 10. For example, instead of a cylindrical section 706, a rectangular parallel piped (not illustrated) or a hexagonal prism shaped (not illustrated) structure may be employed.

FIG. 7B is a side plan view of a the picker apparatus 12 of FIG. 7A designed to be lowered from the surface through the hollow interior of the superjacent helical pipe assembly or piling apparatus 10 into the open top of the integral coupler assembly/nose cone device 11. In this FIG. 7B, a range of motion for each hinged pin 702 as illustrated by directional arrows. The pins 702 of the picker apparatus 12 are designed to engage flanges 704 that are positioned on the wall 42 of the coupler assembly as illustrated in FIG. 7C described below.

Figure 7C:
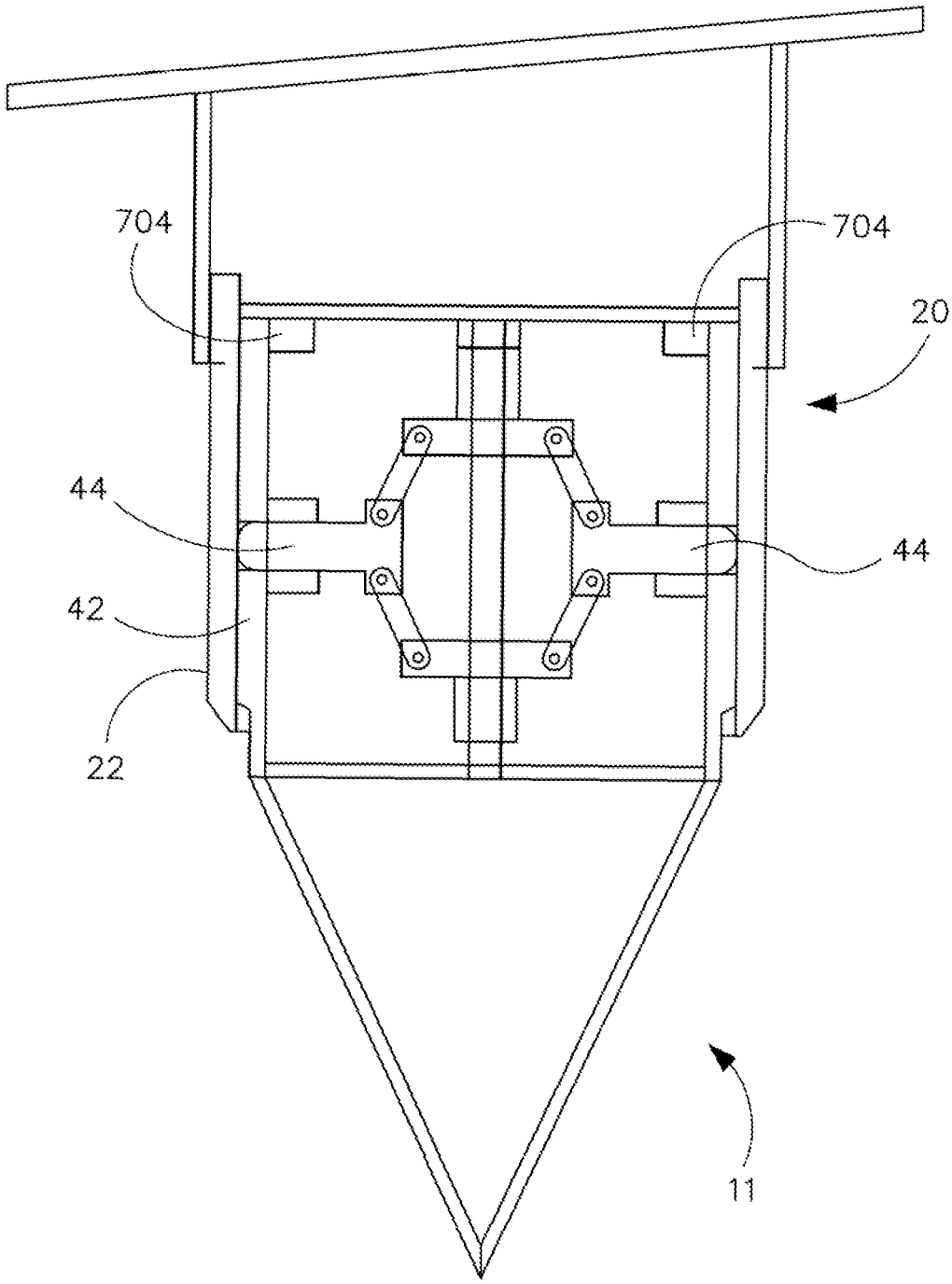
FIG. 7C is a side plan view of nose cone device with flanges for engaging with pins of the picker apparatus of FIGS. 7A-7B.

FIG. 7C is a side plan view of nose cone device 11 having flanges 704 for engaging with pins 702 of the picker apparatus 12 of FIGS. 7A-7B. As noted previously, the flanges 704 positioned on the wall 42 of the coupler assembly are designed to engage the pins 702 of the picker apparatus 12. FIG. 7C illustrates a nose cone device 11 with its shear pins 44 retracted so that the flanges 704 may easily engage the pins 702 of the picker apparatus 12 for removing the nose cone device 11 through the coupler pipe section 21.

FIG. 8 is a plan view showing the "picker" apparatus 12 after being lowered from the surface and deployed inside the top of the integral coupler assembly/nose cone device 11 while still inside the coupler section 20. In this Fig., the pins 702 are shown to be engaged with the flanges 704 of the wall 42 of the coupler assembly. Once the shear pins 44 have been disengaged from the coupler pipe section 21 (and particularly the splice ring 22) and the vertical disengagement shaft section 30 removed, the eight upwardly hinged pins 702 will fall back into place beneath projecting top flanges 704 of the integral coupler assembly/nose cone device 11. This allows for the swift removal of the nose cone device 11 through the coupler section 20 to the surface by means of a cable 802—which is shown positioned above coupler section 20.

As understood by one of ordinary skill in the art, any number of pins 702 or a similar engagement mechanism may be employed, depending on the particular overall design.

Figures 9A, 9B, 9C:
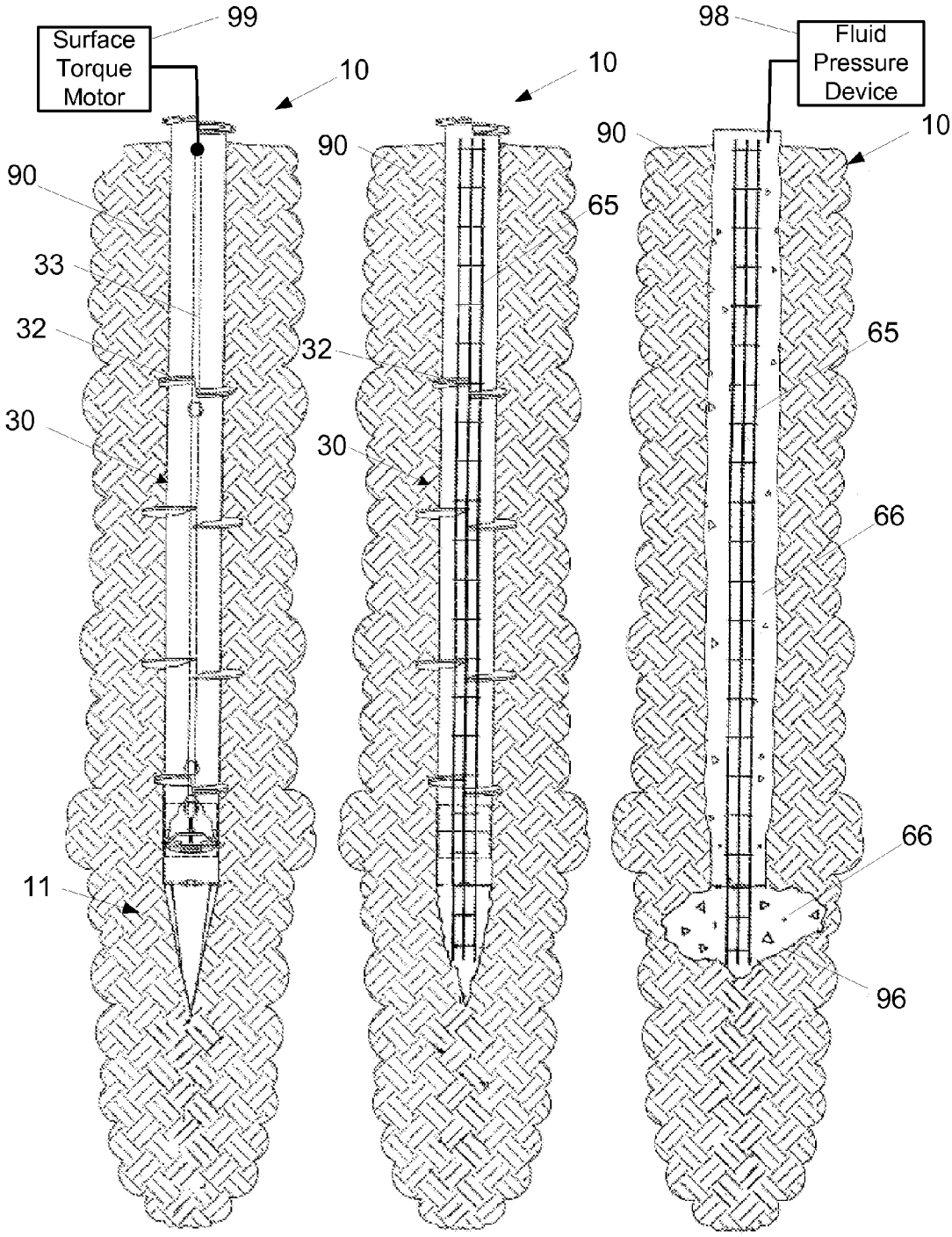
FIG. 9A illustrates an installation of a reinforced concrete pile using a helical piling system with a retractable nose cone device that is fully extended.
FIG. 9B illustrates the installation of the reinforced concrete pile as illustrated in FIG. 9A, but with the nose cone device removed and without the use of any terminal helical anchor.
FIG. 9C illustrates the installation of the reinforced concrete pile as illustrated in FIG. 9B with the nose cone device removed and using fluid pressure to force concrete into an opening below the hollow piling.

FIGS. 9, 10, & 12 illustrate installations of exemplary piling apparatus 10. Specifically, FIG. 9A illustrates an installation of a reinforced concrete pile using a helical piling system 10 with a retractable nose cone device 11 that is fully extended. According to this exemplary embodiment illustrated in FIG. 9A, a surface torque motor 99 may be coupled to the removable segmented shaft 33 for rotating the shaft 23 as well as the entire pipe section 30 such that it is rotated to penetrate the ground 90. Exemplary motors 99 include, but are not limited to, combustion engine types, electric motors, pneumatic motors, and hydraulic motors.

Figures 10A, 10B, 10C:
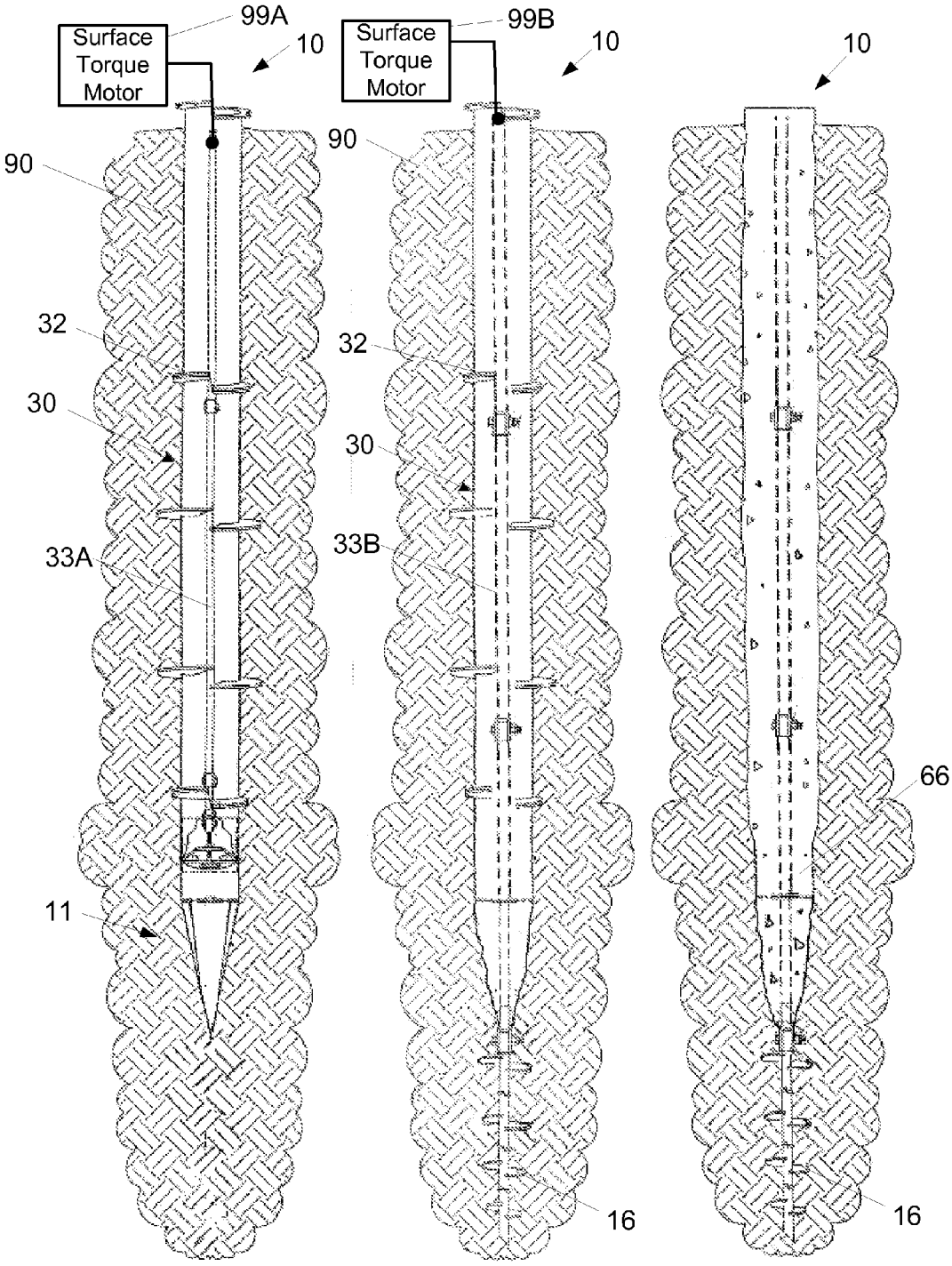
FIG. 10A illustrates an installation of a reinforced concrete pile using a helical piling system with a retractable nose cone device that is fully extended.
FIG. 10B illustrates the installation of the reinforced concrete pile as illustrated in FIG. 10A by using a terminal helical anchor that is installed after the removal of the nose cone device.
FIG. 10C illustrates the installation of the reinforced concrete pile as illustrated in FIG. 10B by using the helical anchor and corresponding round or square shaft as a central reinforcing rod after concrete is poured into the cavity created by the helical piling system.

FIG. 9B illustrates the installation of the reinforced concrete pile as illustrated in FIG. 9A, but with the nose cone device 11 removed and without the use of any terminal helical anchor 16 (see FIGS. 10B-10C for anchor 16). According to this exemplary embodiment illustrated in FIG. 9B, the segmented shaft 33 and the nose cone device 11 have been removed from the pipe sections 30. A plurality of rods forming a steel rod cage 65 have been inserted into the pipe section 30.

FIG. 9C illustrates the installation of the reinforced concrete pile as illustrated in FIG. 9B with the nose cone device 11 removed and using fluid pressure to force concrete 66 into an opening 96 below the hollow piling. According to this exemplary embodiment illustrated in FIG. 9C, the pipe sections 30 have been removed along with the nose cone device 11. The fluid pressure that forces the concrete 66 into the opening 96 below the hollow piling may be created with a fluid pressure device 98. The fluid pressure device 98 may comprise an air or pneumatic device.

However, other types of fluid pressure devices 98 may be used as understood by one of ordinary skill in the art. For example, a water pump or other type of fluid pump may be used to create the fluid pressure needed to force the concrete 66 down into the cavity formed by the piling system 10. The fluid pressure device 98 may create a significant amount of pressure that causes the opening 96 below the piling to have a "mushroom" shape. When the opening 96 has a dimension which is greater than the cavity formed by the piling system 10, this opening 96 having a greater surface area will further provide additional reinforcement for the piling as understood by one of ordinary skill in the art.

FIG. 10A illustrates an installation of a reinforced concrete pile using a helical piling system 10 with a retractable nose cone device 11 that is fully extended. Similar to the exemplary embodiment illustrated in FIG. 9A, a first surface torque motor 99A is used to rotate the entire pipe section 30 such that it is rotated to penetrate the ground 90. Exemplary motors 99A include, but are not limited to, combustion engine types, electric motors, pneumatic motors, and hydraulic motors.

FIG. 10B illustrates the installation of the reinforced concrete pile as illustrated in FIG. 10A by using a terminal helical anchor 16 that is installed after the removal of the nose cone device 11 and the first shaft 33A. According to this exemplary embodiment illustrated in FIG. 10B, after the first shaft 33A and nose cone device 11 have been removed, the anchor 16 is inserted through the pipe sections 30. A second shaft 33B may then be inserted into pipe sections 30. A second surface torque motor 99B may be used instead of the first surface torque motor 99A to rotate the second shaft 33B. This second surface torque motor 99B may have more or less power relative to the first surface torque motor 99A. Alternatively, the first surface torque motor 99A may be used to drive this second shaft 33B.

The second shaft 33B may have more or less strength relative to the first shaft 33A depending on the torque requirements to rotate the anchor 16. Since the second shaft 33B may have less strength, it may be made with cheaper or less expensive materials relative to the materials used to produce the first shaft 33A. According to this exemplary embodiment, the second shaft 33B may be designed to be left into the ground 90 after the anchor 16 has been rotated for insertion into the ground 90.

At this stage as illustrated in FIG. 10B, additional torque may be applied and measured from the surface so as to accurately gauge the compression or tensioning capacity of the helical anchor 16. Torque may be measured at the surface using a torque measuring device 88. The torque measuring device 88 may be coupled to the torque motor 99B and/or it may be coupled directly to the second shaft 33B. The torque measuring device 88 may include an in-line torque meter, a differential pressure meter attached to hydraulic lines, and/or other similar devices as understood by one of ordinary skill in the art. The helical anchor 16 may be rotated and extended deeper into the underlying soil region or ground 90 in order to obtain the desired additional compression or tensioning capacity. The segmented metal round shaft 33B having the slip connection 18 can then be left in place in lieu of steel reinforcing rod 65 to reinforce the concrete column 66 and/or to provide electrical grounding.

The resulting concrete piling has a capacity in compression and tension that is based on the friction between the soil/ground 90 and the concrete 66 along the length of the concrete piling plus the bearing capacity of the soil 90 below or the tensioning capacity of the soil above the mushroom 96 or the helical screw anchor 16.

FIG. 10C illustrates the installation of the reinforced concrete pile as illustrated in FIG. 10B by using the round or square helical anchor 16 and corresponding second shaft 33B as a central reinforcing rod after concrete 66 is poured into the cavity created by the helical piling system 10. As illustrated in this exemplary embodiment of FIG. 10C, the pipe sections 30 and nose cone device 11 of the piling system 10 have been removed from the ground 90. The only remaining structures in the cavity formed by the piling system 10 are the anchor 16A and the second shaft 33B.

Figures 12A, 12B, 12C, 12D:
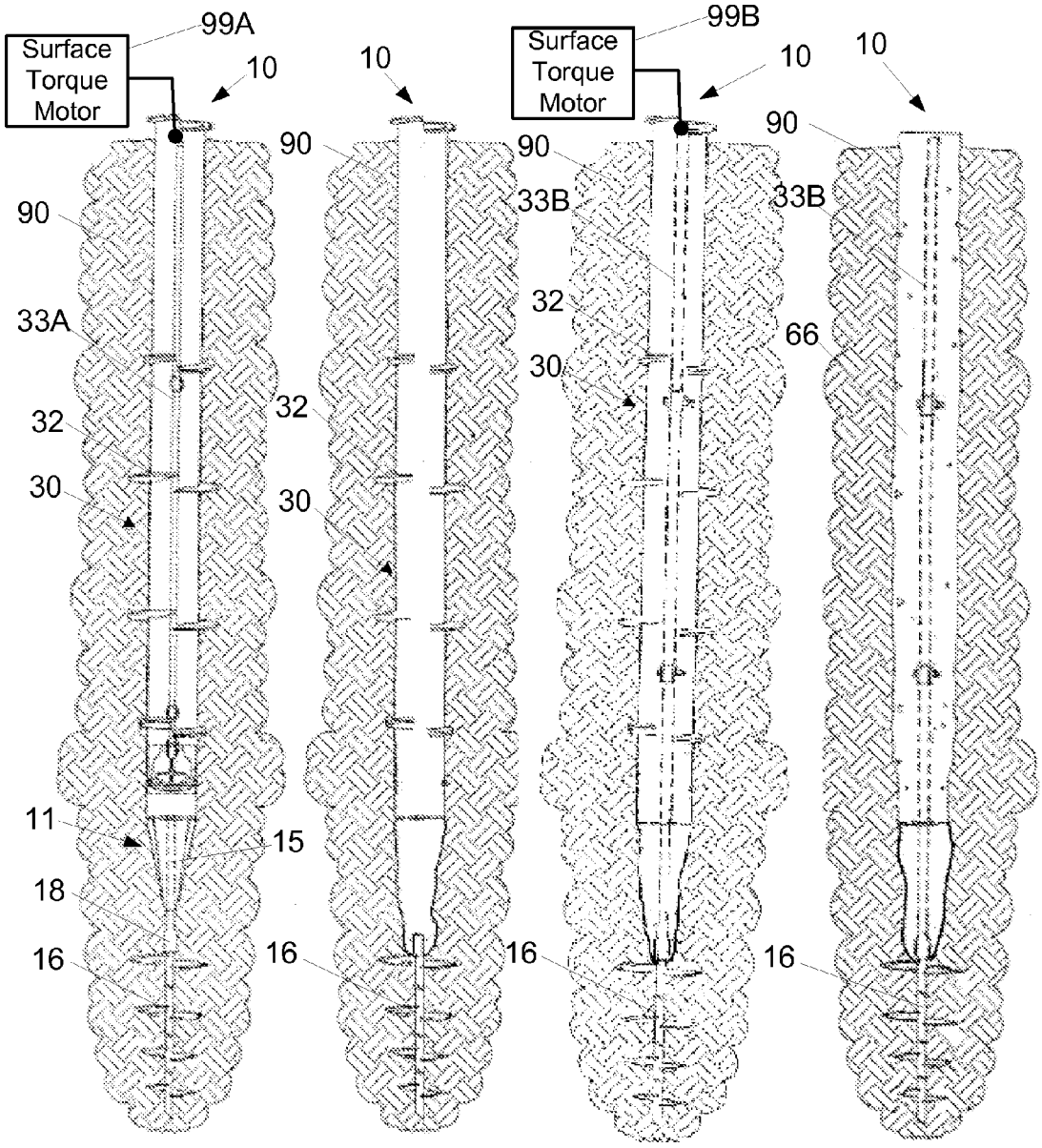
FIG. 12A illustrates a special installation of an exemplary piling system, wherein the retractable coupler assembly/nose cone device has a helical anchor.
FIG. 12B illustrates the piling system of FIG. 12A with the nose cone device 11 removed and the helical anchor remaining in the ground.
FIG. 12C illustrates the piling system of FIG. 12B with a second shaft extending through the piping sections for engaging the helical anchor.
FIG. 12D illustrates the piling system of FIG. 12C with the piping sections removed and the second shaft and helical anchor remaining in the ground after concrete has been poured.

FIG. 12A illustrates a special installation of an exemplary piling system 10, wherein the retractable coupler assembly/nose cone device 11 has a helical anchor 16 for penetrating the ground 90. The helical anchor 16 is positioned below the nose cone device 11 and may have helices which are larger in diameter than helices 32 of pipe sections 20 and 30.

The coupler assembly/nose cone device 11 may be outfitted with an internal round metal shaft projecting through the tip 19 of the nose cone device 11 and terminating in a slip connection 18 that engages (when rotated in a clockwise direction) a projecting bar (See FIGS. 13C-13D) at the distal end of the helical anchor 16.

A first surface torque motor 99A is used to rotate the entire pipe section 30 to penetrate the ground 90. Exemplary motors 99A include, but are not limited to, combustion engine types, electric motors, pneumatic motors, and hydraulic motors.

FIG. 12B illustrates the piling system 10 of FIG. 12A with the nose cone device 11 removed and the helical anchor 16 remaining in the ground. According to this exemplary embodiment, the nose device 11 and the first shaft 33A have been removed from the pipe sections 30.

FIG. 12C illustrates the piling system 10 of FIG. 12B with a second shaft 33B extending through the piping sections 30 for engaging the helical anchor 16. A second surface torque motor 99B may be used instead of the first surface torque motor 99A to rotate a second shaft 33B. This second surface torque motor 99B may have more or less power relative to the first surface torque motor 99A. Alternatively, the first surface torque motor 99A may be used to drive this second shaft 33B which in turn rotates the helical anchor 16.

The second shaft 33B may have more or less strength relative to the first shaft 33A depending on the torque requirements to rotate the anchor 16. Since the second shaft 33B may have less strength, it may be made with cheaper or less expensive materials relative to the materials used to produce the first shaft 33A. According to this exemplary embodiment, the second shaft 33B may be designed to be left into the ground 90 after the anchor 16 has been rotated for insertion into the ground 90.

FIG. 12D illustrates the piling system 10 of FIG. 12C with the piping sections 30 removed and the second shaft 33B and helical anchor 16 remaining in the ground 90 after concrete 66 has been poured. As noted previously, the second shaft 33B may be made with cheaper materials relative to the first shaft 33A and hence its strength may be less than the strength of the first shaft 33A. However, the second shaft 33B may be designed to be left in the ground 90 as further reinforcement for the concrete 66 that is poured around the shaft 33B.

Thus, FIGS. 12A-12D illustrate the installation of a reinforced concrete pile using a helical piling system 10 with a retractable nose cone device 11. The system 10 uses a terminal helical anchor 16 that is installed at the same time as the retractable nose cone device 11. After hitting a target depth in the ground 90, the nose cone device 11 is then removed from the terminal helical anchor 11 by means of a reversible slip connection between the two devices. After the nose cone device 11 is removed, additional torque may be applied to the helical anchor 16 from the surface motor via a second shaft 33B and measured using a torque measuring device 88 (not illustrated in FIG. 12, but see FIG. 10B). And the round helical anchor 16 may be left in place as the central reinforcing rod for the eventual concrete pile formed with concrete 66 poured around the second shaft 33B.

Figures 13A, 13B, 13C, 13D, 13E:
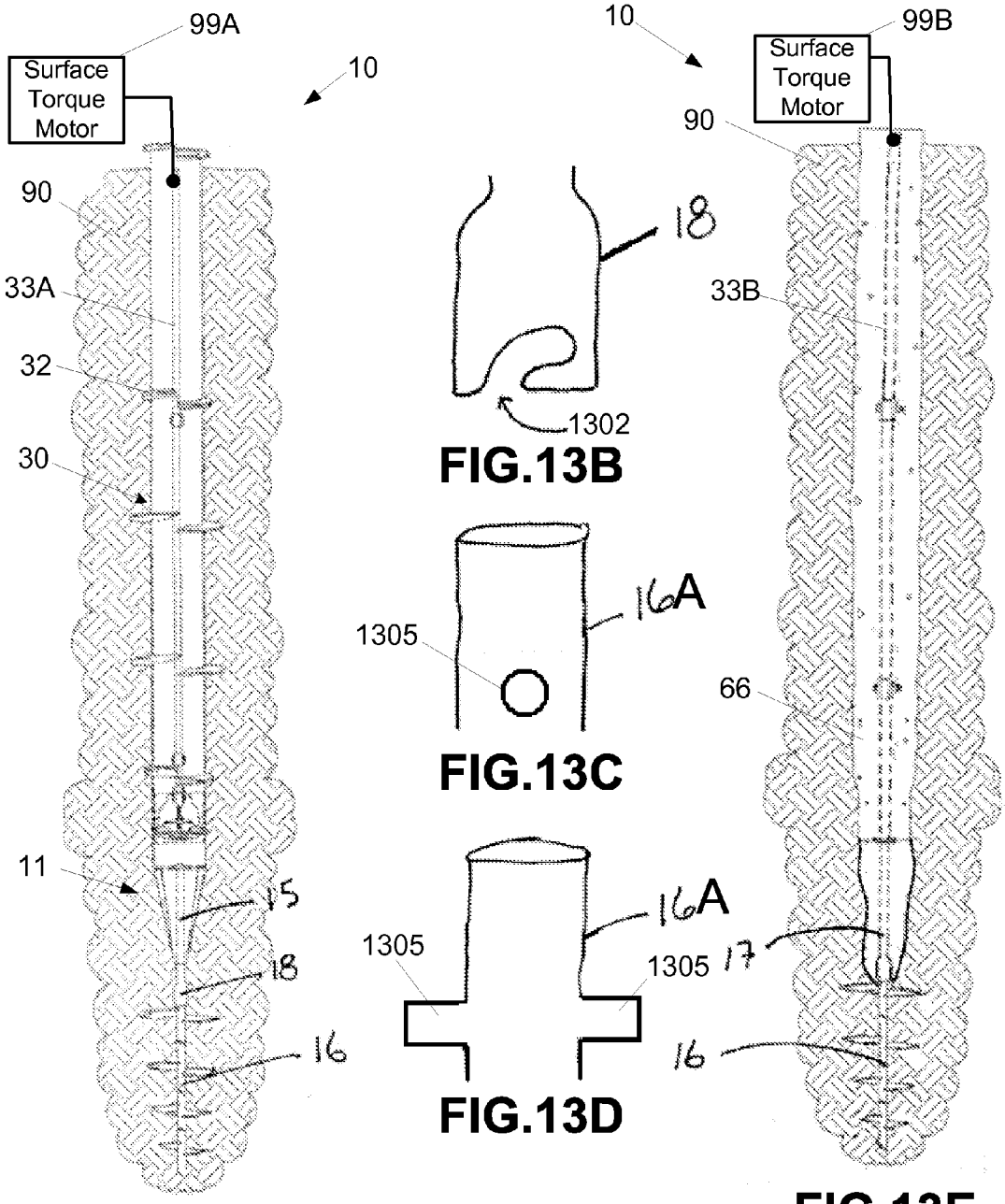
FIG. 13A illustrates a piling system 10 having an integral coupler assembly/nose cone device that has an anchor 16.
FIG. 13B illustrates a slip connection that allows the nose cone device to connect to the anchor illustrated in FIG. 13A.
FIG. 13C illustrates the upper end portion of the anchor that is connected to the nose cone device illustrated in FIG. 13A via the slip connection.
FIG. 13D illustrates another view of the end portion of the anchor of FIG. 13C that is connected to the nose cone device illustrated in FIG. 13A via the slip connection.
FIG. 13E illustrates the piling system 10 of FIG. 13A after the pipe section and nose cone device have been removed from the ground.

FIG. 13A illustrates an integral coupler assembly/nose cone device 11 that has an anchor 16. The nose cone device 11 may be outfitted with an integral round metal shaft 15 with a slip connection 18 at the end which will engage a horizontal bar 1305 (See FIGS. 13C-13D) in the distal end of a helical anchor 16.

FIG. 13B illustrates the slip connection 18 in detail for the nose cone device 11 illustrated in FIG. 13A. The slip connection 18 may comprise an opening 1302 which is designed to engage a corresponding end portion of the anchor 16.

FIG. 13C illustrates an end portion 16A of the anchor 16 that is part of the nose cone device 11 illustrated in FIG. 13A. The end portion 16A comprises a horizontal bar 1305 shown entering into the page in FIG. 13C.

FIG. 13D illustrates another view of the end portion 16A of the anchor 16 of FIG. 13C that is part of the nose cone device 11 illustrated in FIG. 13A. In this exemplary embodiment, the full horizontal length of the bar 1305 as illustrated.

FIG. 13E illustrates the piling system 10 after the pipe section 30 and nose cone device 11 have been removed from the ground 90. According to this exemplary embodiment, a second shaft 33B and the helical anchor 16 may remain in the ground for reinforcing concrete 66 that is poured around the second shaft 33B.

In view of FIGS. 13A-13E, once the integral coupler assembly/nose cone device 11 is removed using the picker device 12, a segmented round extension shaft 33B with an analogous slip connection 18 can be extended down from the surface and rotated in a clockwise direction. The slip connection 18 may fit over and engage the exposed distal end 16A of the seated helical anchor 16. To facilitate that process, small projecting fins or guides (not illustrated) may be welded to segmented round shaft 33B above slip connection 18 itself so as to keep it within and positioned at or near the center of pipe sections 30 & 20 during its descent. At this stage, additional torque may be applied and measured from the surface so as to accurately gauge the compression or tensioning capacity of the helical anchor 16. The helical anchor 16 may be rotated and extended deeper into the underlying soil region or ground 90 in order to obtain the desired additional compression or tensioning capacity. The segmented metal round shaft 33B having the slip connection 18 can then be left in place in lieu of steel reinforcing rod 65 to reinforce the concrete column 66 and/or to provide electrical grounding.

The resulting concrete piling has a capacity in compression and tension that is based on the friction between the soil/ground 90 and the concrete 66 along the length of the concrete piling plus the bearing capacity of the soil 90 below or the tensioning capacity of the soil above the mushroom 96 or the helical screw anchor 16.

Figure 14A:
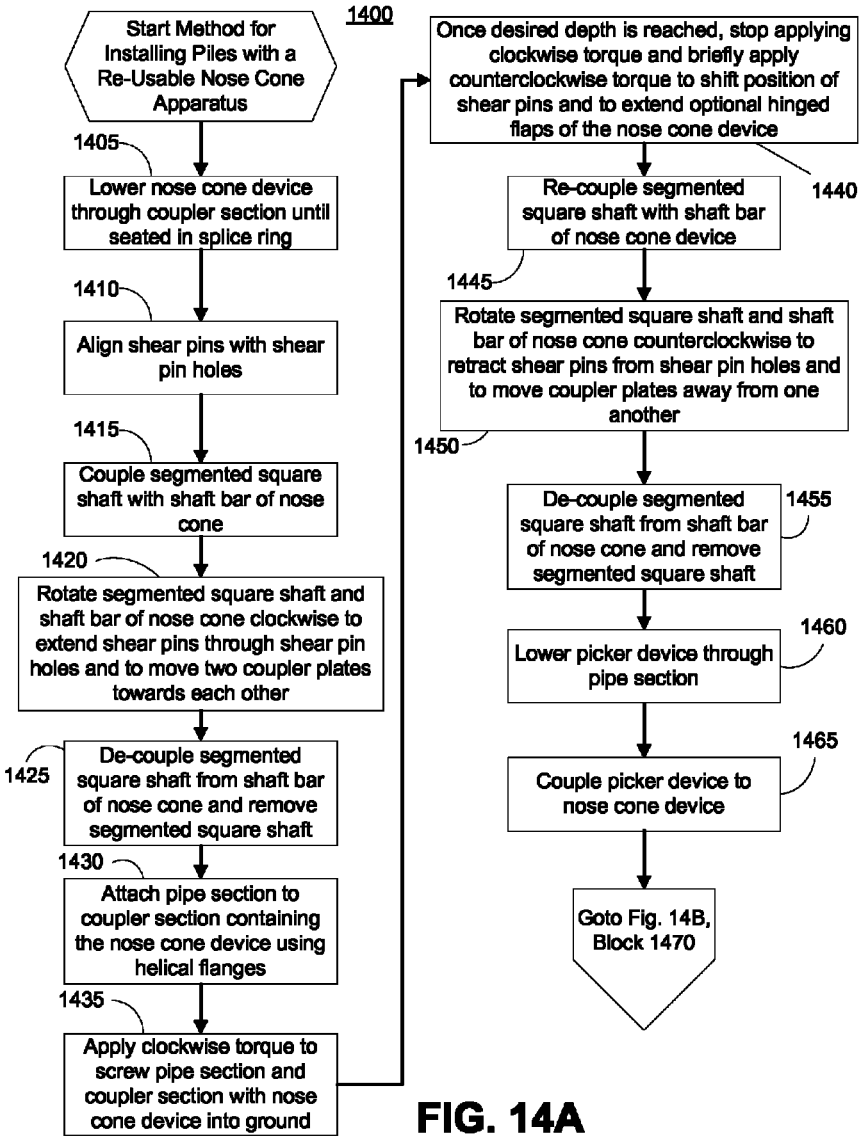
FIGS. 14A-14B are diagrams of a flowchart for a method for installing piles with a re-useable nose cone system.
Figure 14B:
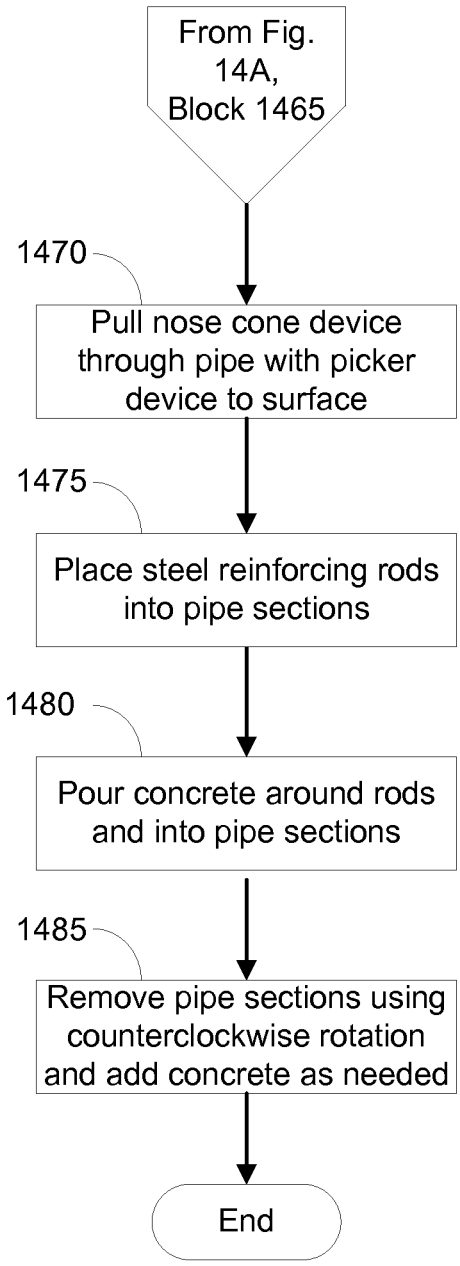

Referring generally now to FIGS. 14A-14B, details regarding exemplary procedures or methods 1400 for installing either (i) reinforced concrete piles and/or (ii) grounding systems into the ground, without utilizing a pile driver or an auger and without unnecessary sacrifice of materials, are described as follows:

The integral coupler assembly/nose cone device 11 is lowered down through coupler section 20 until seated against the lower internal flange on splice ring 22 (Block 1405) and oriented such that the shear pins 44 are aligned with the elongated shear pin holes 50 in splice ring 22 (Block 1410).

The magnetized lower female end of segmented square shaft 33 is removably inserted over and around the smaller male end of short square shaft bar 24, which is welded to the threaded rod 48 (Block 1415). The short square shaft bar 24 is then rotated clockwise (Block 1420). The clockwise rotation of the threaded rod 48 forces the upper coupler plate 46 and welded nut 47A downward and the lower coupler plate 46 and welded nut 47B upward, which in turn causes the shear pin positioning arms 52 to push the shear pins 44 through circular shear pin holes 45 in exterior wall 42 and then through the elongated shear pin holes 50 in splice ring 22.

Once the shear pins 44 protrude through elongated shear pin holes 50 and are fully extended, further torque will cause the integral coupler assembly/nose cone device 11 to rotate slightly so that the shear pins 44 lodge tightly at the narrow end of the elongated shear pin holes in splice ring 22 that is part of coupler section 20.

At this stage, square shaft 33 is removed and set aside (Block 1425). A pipe section 30 with the standard width helices 32 is then bolted to the coupler section 20 containing the firmly seated integral couple assembly/nose cone device 11 (Block 1430). All of the pipe sections, 20 & 30, have helical flanges 23A,B at each end. These flanges 23 serve at least two purposes. The first is for splicing of the pipe sections 20 & 30. The second is for when the pipe sections 20 & 30 are required to be inserted in the ground or removed.

Clockwise and counterclockwise torque, respectively, can then be applied to the pipe sections 20 and 30 using a torque motor 99 at the surface end of the entire piling assembly; and the helical flanges 23 will cause the pipe sections 20, 30 to "screw" themselves unto the ground 90 or "unscrew" themselves out of the ground 90, as the case may be (Block 1435).

The torque required for installation and removal is always applied to the surface end of pipe sections 20 & 30. Because the helical flanges 23 are typically narrow, approximately two inches in width, larger width helices 32 may be required for the removal of the pipe sections 20 & 30. Larger width helices 32 may be bolted to helical flanges 23 when they are assembled together at the surface. In short, one or more pipe sections 30 may require the addition of larger width helices 32 to assist with the surface area needed to screw in or back out all of the pipe sections 20 & 30, depending on pipe width and depth and soil type.

Once all of the pipe sections 20 & 30 have been extended or screwed into the ground to a desired depth (see FIG. 9) (Block 1440), the surface torque motor 99 is reversed and the brief counterclockwise rotation of pipe sections 20 & 30 is designed to cause shear pins 44 to shift to the wide end of the elongated shear pin holes 50 in coupler section 20, relieving any tension and facilitating their retraction.

To keep the integral coupler assembly/nose cone device 11 stable while surrounding coupler section 20 is being counter-rotated, the exterior of the nose cone device 11, in addition to small helices 32, may be outfitted with a number of hinged flaps (not illustrated), which will deploy and impede any counterclockwise rotation of the integral coupler assembly/nose cone device 11.

Next, the segmented square shaft 33, with its magnetized lower female end, is extended from the surface down through pipe sections 30 & 20 until its female end is again removably inserted over and around the smaller male end of short square shaft bar 24 (Block 1445). To facilitate that process, small projecting fins or guides (not illustrated) may be welded to the female end of segmented square shaft 33 so as to keep it positioned at or near the center of pipe sections 30 & 20 during its descent. Once they are reconnected, the square shaft bars 33 & 24 are rotated counterclockwise (Block 1450). The resultant counterclockwise rotation of the threaded rod 48 in the coupler assembly forces the upper coupler plate 46 and welded nut 47A upward and the lower coupler plate and welded nut 47B downward, which in turn causes the shear pin positioning arms 52 to pull or retract the shear pins 44 out of the shear pin holes 45 & 50, disengaging pipe sections 20 & 30 from the integral coupler assembly/nose cone device 11. The square segmented shaft bar 33 is then pulled up through the pipe sections 20 & 30 and set aside (Block 1455).

The picker device 12 shown in FIGS. 7 & 8 is then lowered down from the surface by cable through pipe sections 20 & 30 (Block 1460) until it locks into the top of the integral coupler assembly/nose cone device 11 (Block 1465). Then, the cable 802 is used to pull the disengaged coupler assembly/nose cone device 11 to the surface (Block 1470, FIG. 14B), where it is set aside.

Steel reinforcing rods 65 may then be placed into pipe sections 20 & 30 (Block 1475) (see FIG. 9). Concrete 66 is then poured into the pipe sections 20 & 30 in volumes approximating the length of one or more pipe sections 30 (Block 1480). The pipe sections 30 are removed by "unscrewing" them one-by-one, making certain that the top surface of the wet concrete is always above the bottom helical flange 23 of the bottommost pipe section 30 (Block 1485).

This may be done by intermittently adding more concrete until all of the pipe sections 20, 30 have been removed so that the hole previously occupied by the pipe sections 20, 30 is completely filled with wet concrete (see FIG. 9). The principal purpose served by the foregoing steps of incrementally filling and alternately removing pipe sections 30 one-by-one is to reduce the amount of surface torque required to "unscrew" the entire assembly pipe sections 30. As suggested above, however, depending on pipe width and depth, size and number of helices 32, power of surface torque motor 99, and soil type, all or a large portion of pipe sections 20 & 30 may be filled with wet concrete before any removal of pipe sections is begun.

During the process of filling pipe sections 20 & 30 with wet concrete, a special cap (not illustrated) may be attached to helical flange 23 on uppermost pipe section 34 with a connection for an air nozzle. This air nozzle may permit fluid pressure such as from air to be applied with a fluid pressure device 98 to the interior of the hollow pipe sections 30. The air pressure applied on top of the wet concrete column will force the bottom of the wet concrete column into the space 96 vacated by the integral coupler assembly/nose cone device 11.

This forcing of concrete 66 into surrounding soils may result in a mushroom effect that increases the surface area at the end of the piling, creating additional horizontal load bearing capacity once the wet concrete is set. This method of applying fluid pressure can be employed before any of the pipe sections 20 & 30 are removed, though partial removal of the lowest pipe sections usually increases the mushroom effect as understood by one of ordinary skill in the art.

Alternatively, once the integral coupler assembly/nose cone device 11 is removed using the picker device 12, a conventional helical screw anchor 16 and a segmented extension shaft 33B coupled to the helical screw anchor 16 can be screwed into the ground 90 exposed by the removal of the nose cone device 11 and directly beneath the vertical column of air within pipe sections 20 & 30. This would allow the installer of the round or square shaft helical anchor 16 to monitor the helical anchor 16 for installation torque independently of the torque required to install pipe sections 20 & 30. Likewise, the segmented metal round shaft 33B or a square shaft can be left in place in lieu of steel reinforcing rod 65 to reinforce the concrete column 66 and/or to provide electrical grounding.

As a further alternative, the integral coupler assembly/nose cone 11 may be outfitted with an integral round metal shaft 15 with a slip connection 18 at the end as depicted in FIG. 13A, which will engage a horizontal bar in the distal end of a standard helical anchor 16, with some helices larger in diameter than pipe sections 20 & 30, so that once the integral coupler assembly/nose cone 11 is removed using the picker device 12, a segmented round extension shaft 33B with an analogous slip connection can be extended down from the surface and rotated in a clockwise direction so as to fit over and engage the exposed distal end of the seated helical anchor, whereupon additional torque is applied and measured from the surface so as to accurately gauge the compression or tensioning capacity of the helical anchor in question, which may then be rotated and extended deeper into the underlying soil region in order to obtain the desired additional compression or tensioning capacity. The segmented metal round shaft 33B can then be left in place in lieu of steel reinforcing rod 65 to reinforce the concrete column and/or to provide electrical grounding.

The resulting concrete piling has a capacity in compression and tension that is based on the friction between the soil and the concrete 66 along the length of the concrete piling plus the bearing capacity of the soil below or the tensioning capacity of the soil above the mushroom or the helical screw anchors 16.

As described above, many of the parts of the system 10 are manufactured from materials such as metal. However, other materials are included with the scope of the system 10. Other materials include, but are not limited to, ceramics, plastics, etc., as understood by one of ordinary skill in the art.

In addition to the above-described procedure or method 1400 for installing the reinforced concrete piling apparatus 10, a method of improved electrical grounding associated with either a tension or compression pile utilizing the above helical anchor oriented method 1400 is also disclosed. In situations where electrical grounding is a prime consideration, the installer may want to use a copper bonded helical anchor 16 and may want to apply so-called grounding grout in the bottom of the hollow vertical column formed by pipe sections 20 & 30 prior to filling the remainder of the column with wet concrete 66. A round or square segmented extension shaft 33B extending to the surface that was used to screw in the helical anchor 16 may be left in the ground 90 for purposes of both conductivity and structural reinforcement of the concrete pile.

In view of the above system 10 and method 1400, advantages over those methods utilizing a pile driver have been realized and include, but are not limited to: no pile-driving greatly reduces noise and vibrations that affect surrounding buildings and upset neighbors; no jetting—avoids run-off and water contamination; and the system 10 can be installed using much smaller equipment relative to methods using a pile driver.

In view of the above system 10 and method 1400, advantages over those methods utilizing an auger have been realized and include, but are not limited to: Helical systems 10 eliminate the mess and high cost of spoils removal; unlike augering, helical systems 10 increase soil compaction and load capacities; and helical systems 10 can be installed using much smaller equipment relative to methods using an auger.

The installer of a reinforced concrete piling, through the use of a decoupling apparatus as provided in this system, has the ability, after pouring the reinforced concrete piling in place, to remove all of the helical pipe sections or casings connected to one another by the use of helical flanges.

The inventive system described has cylindrical hollow metal pipe sections of uniform width which overcomes the problem of insertion and removal torque by (i) joining the removable pipe sections by bolting them together via their helical flanges so as to provide for easy assembly and disassembly and to eliminate the friction of connection joints and by (ii) use of modern torque-generating devices.

With the inventive system, conventional torque devices may be inexpensively outfitted on a relatively small and portable rubber track excavator or similar machine, so that there are tremendous cost savings with this inventive system—irrespective of any "head room" issues—to utilizing a so-called "plurality of interconnected sections", such that the length of the lower section can be built up as it progresses down the hole.

What has been disclosed is a reinforced concrete piling system that can not only be installed in the ground without requiring a pile driver or an auger, with the ability to use small equipment in environmentally sensitive areas or those with limited access, and without the necessity of leaving in the ground and sacrificing all of the expensive helical pipe sections or casings themselves. The inventive system also allows (i) the removal and reuse of the expensive nose cone and (ii) the opportunity to (a) access from the surface the region of compacted soil vacated by the removed nose cone for purposes of screwing a conventional helical anchor directly into that soil from the surface by communicating torque from a surface motor via a round or square shaft extending down from the surface through the hollow column formed by the helical casings and (b) accurately measure the torque (and hence the additional "load" bearing or "pull" resisting capacity) of the helical anchor itself (as opposed to the entire superjacent helical pipe assembly) where needed for additional support or "tensioning" capacity to complement the eventual superjacent concrete piling, with the round or square shaft of the helical anchor being left in place for reinforcement and/or for electrical grounding purposes.

Thus, apparatus and methods for installing either (i) reinforced concrete piles and/or (ii) grounding systems into the ground, without utilizing a pile driver or an auger, without unnecessary sacrifice of materials, and with the opportunity for efficient use of a terminal helical anchor, have been disclosed. It is to be understood that the above-described embodiments are merely illustrative of some of the many specific embodiments that represent applications of the principles discussed above. Clearly, numerous other arrangements can be readily devised by those skilled in the art without departing from the scope of the methods and systems described.

The word "exemplary" is used in this description to mean "serving as an example, instance, or illustration." Any aspect described herein as "exemplary" is not necessarily to be construed as preferred or advantageous over other aspects.

Certain steps in the processes or process flows described in this specification naturally precede others for the invention to function as described. However, the invention is not limited to the order of the steps described if such order or sequence does not alter the functionality of the invention. That is, it is recognized that some steps may performed before, after, or parallel (substantially simultaneously with) other steps without departing from the scope and spirit of the invention. In some instances, certain steps may be omitted or not performed without departing from the invention. Further, words such as "thereafter", "then", "next", etc. are not intended to limit the order of the steps. These words are simply used to guide the reader through the description of the exemplary method.

Although selected aspects have been illustrated and described in detail, it will be understood that various substitutions and alterations may be made therein without departing from the spirit and scope of the present invention, as defined by the following claims.

What is claimed is:

1. A method for installing a piling, comprising:

providing a piling, the piling comprising a pipe;

sliding a detachable nose cone device through a coupler section of the pipe, the pipe having at least one helix;

coupling the detachable nose cone device to the coupler section of the pipe by activating a first set of one or more locking mechanisms that are part of the detachable nose cone device;

applying torque to the pipe in order to rotate the pipe, coupler section, and detachable nose cone device into ground with the helix engaging the ground;

removing the detachable nose cone device from the coupler section and from the pipe by deactivating the first set of one or more locking mechanisms and by coupling the nose cone device to a detachable picker device, the picker detachable device having a second set of one or more locking mechanisms that engage the detachable nose cone device, wherein at least the pipe remains in the ground after torque has been applied to the pipe.

2. The method of claim 1, wherein activating the first set of one or more locking mechanisms further comprises extending pins.

3. The method of claim 1, wherein the pipe is a first pipe, the method further comprising coupling a second pipe to the first pipe.

4. The method of claim 3, further comprising rotating the first pipe and second pipe so that at least one helix engages a surface.

5. The method of claim 4, further comprising deactivating the one or more locking mechanisms.

6. The method of claim 5, wherein deactivating the one or more locking mechanisms further comprises rotating a shaft.

7. A system for installing a piling comprising:

providing a piling, the piling comprising a pipe;

means for sliding a detachable nose cone device through a coupler section of the pipe, the pipe having at least one helix;

means for coupling the detachable nose cone device to the coupler section of the pipe that includes activating a first set of one or more locking mechanisms that are part of the detachable nose cone device;

means for applying torque to the pipe in order to rotate the pipe, coupler section, and detachable nose cone device into ground with the helix engaging the ground; and means for removing the detachable nose cone device from the coupler section and from the pipe by deactivating the first set of one or more locking mechanisms and by coupling the nose cone device to a detachable picker device, the detachable picker device having a second set of one or more locking mechanisms that engage the detachable nose cone device, wherein at least the pipe remains in the ground after torque has been applied to the pipe.

8. The system of claim 7, wherein the first set of one or more locking mechanisms further comprises one or more pins.

9. The system of claim 8, wherein means for coupling further comprises a rotatable shaft that causes pins to extend.

10. The system of claim 8, wherein the pipe is a first pipe, the system further comprising means for coupling a second pipe to the first pipe.

11. The method of claim 10, wherein activating the first set of one or more locking mechanisms further comprises rotating a shaft that causes pins to extend.

12. The system of claim 10, wherein the means for coupling the second pipe to the first pipe comprises helical flanges.

13. A system for installing a piling comprising:

providing a piling, the piling comprising a pipe;

a detachable nose cone device;

a coupler section of the pipe, the pipe having at least one helix, the detachable nose cone device being slidingly engaged with the coupler section of the pipe, the detachable nose cone device being coupled to the coupler section of the pipe by a first set of one or more locking mechanisms, wherein when torque is applied to the pipe the pipe, coupler section, and detachable nose cone device rotate and enter into ground with the helix engaging the ground; and a detachable picking device slidingly engagable with the coupler section of the pipe and for coupling to the detachable nose cone device, and for removing the detachable nose cone device from the coupler section of the pipe by deactivating the first set of one or more locking mechanisms and by engaging the detachable nose cone device with a second set of one or more locking mechanisms on the detachable picking device which pull the detachable nose cone device through the coupler section, wherein at least the pipe remains in the ground after torque has been applied to the pipe.

14. The system of claim 13, wherein the first set of one or more locking mechanisms comprise one or more pins.

15. The system of claim 13, further comprising a shaft that activates the first set of one or more locking mechanisms.

16. The system of claim 15, wherein the shaft is rotatable.

17. The system of claim 15, further comprising a helical screw anchor.

18. The system of claim 17, wherein the helical screw anchor is coupled to the detachable nose cone device.

19. The system of claim 18, wherein the helical screw anchor is detachably coupled to the detachable nose cone device.

* * * * *